US007172536B2

(12) United States Patent
Liu

(10) Patent No.: US 7,172,536 B2
(45) Date of Patent: Feb. 6, 2007

(54) ADJUSTABLE DUMBBELL

(76) Inventor: Wei Ming Liu, 8F-2, No. 3, Ankang Road, Fonyuan City, Taichung Hsien 42083 (TW)

( * ) Notice: Subject to any disclaimer, the term of this patent is extended or adjusted under 35 U.S.C. 154(b) by 87 days.

(21) Appl. No.: 11/069,678

(22) Filed: Mar. 1, 2005

(65) Prior Publication Data

US 2006/0240958 A1 Oct. 26, 2006

(51) Int. Cl.
*A63B 21/075* (2006.01)
*A63B 21/06* (2006.01)

(52) U.S. Cl. ..... 482/108; 482/93

(58) Field of Classification Search ..... 482/106–109, 482/93–95, 97; D21/681–683
See application file for complete search history.

(56) References Cited

U.S. PATENT DOCUMENTS 6,416,446 B1 * 7/2002 Krull ..... 482/108
6,656,093 B2 * 12/2003 Chen ..... 482/108
6,997,856 B1 * 2/2006 Krull ..... 482/104
7,011,611 B1 * 3/2006 Ripley ..... 482/107
2002/0055426 A1 5/2002 Krull
2004/0005968 A1 * 1/2004 Crawford et al. ..... 482/106

* cited by examiner

*Primary Examiner*—Jerome Donnelly
*Assistant Examiner*—Fenn C. Mathew
(74) *Attorney, Agent, or Firm*—Charles E. Baxley

(57) ABSTRACT

An adjustable dumbbell includes a number of weights each having a slot to receive end portions of a bar, and a number of latch rods slidably engaged in the weights and each having an inner end engageable into the slots of the weights and engageable with the bar, to anchor and latch a selected number of the weights to the bar, and to allow the selected weights to be moved in concert with the bar. The weights each has a spring member to bias and force the inner end of the latch rod to engage with and to latch the weights to the bar. The weights each includes a panel having an orifice to slidably receive the latch rod, and to anchor the latch rod to the panel when the catch of the knob is rotated relative to the panel.

9 Claims, 9 Drawing Sheets

ADJUSTABLE DUMBBELL

BACKGROUND OF THE INVENTION

1. Field of the Invention

The present invention relates to an adjustable dumbbell, and more particularly to an adjustable dumbbell having a number of weights to be randomly selected and operated.

2. Description of the Prior Art

Various kinds of typical adjustable dumbbells have been developed and comprise a number of weights, and a bar or rod or handle including two ends engaged onto the weights, and two latch rods are slidably engaged in the handle and selectively engageable with one or more of the weights, to selectively and adjustably and randomly secure or attach or lock or couple one or more of the weights to the handle, in order to change the dumbbell to different weights.

For example, U.S. patent application Ser. No. US 2002/0055426 A1 to Krull discloses one of the typical adjustable dumbbells including a number of weights disposed on opposite sides of a base member, and selector rods selectively moved into engagement with the desired number of the weights on each side of the base member, to selectively and adjustably secure or attach or couple the desired number of the weights to the handle. However, the weights should be coupled or secured in series to the handle with the selector rods, but may not be secured or attached onto the handle randomly by the users.

U.S. Pat. No. 6,656,093 to Chen discloses another typical adjustable dumbbell also including a number of weights disposed on opposite sides of a base member, a handle or bar or rod having two ends engaged onto the weights, and two latches slidably engaged in the rod and selectively engageable with the desired number of the weights, to selectively and adjustably secure or attach or couple the desired number of the weights to the rod. However, similarly, the weights should also be coupled or secured in series to the handle with the selector rods, but may not be secured or attached onto the handle randomly by the users.

The present invention has arisen to mitigate and/or obviate the afore-described disadvantages of the conventional adjustable dumbbells.

SUMMARY OF THE INVENTION

The primary objective of the present invention is to provide an adjustable dumbbell including a number of weights to be randomly selected to a rod or handle, and to allow the desired number of the randomly selected weights to be randomly suitably operated by the users.

In accordance with one aspect of the invention, there is provided a adjustable dumbbell comprising a number of weights each including a slot formed therein, a bar including two end portions engageable into the slots of the weights, and a number of latch rods slidably received and engaged within the weights respectively, and each including an inner end engageable into the slots of the weights respectively, and engageable with the bar, to anchor and latch a selected number of the weights to the bar, and to allow the selected weights to be moved in concert with the bar. The weights may be randomly secured to the bar, and are not required to be secured to the bar in series.

The weights each includes a spring member engaged onto the latch rod, to bias and to force the inner ends of the latch rod to engage with and to latch the weights to the bar. The latch rods each includes a stop extended therefrom, for engaging with the spring member. The weights each includes a passage formed therein and communicating with the slot thereof, and a peripheral rib extended into the passage thereof, to form an aperture having a reduced diameter, and to engage with the stop of the latch rod, and to limit the latch rod to move relative to the weight.

The weights each includes a panel secured thereto and having an orifice formed therein and aligned with the passage of the weight, to slidably receive an outer end of the latch rod. The latch rods each includes a knob secured to the outer end thereof, the orifice of the panel includes a non-circular cross section, and the knob includes a catch provided thereon and having a non-circular cross section corresponding to that of the orifice of the panel, to allow the catch of the knob to be moved into and out through the orifice of the panel, and thus to allow the catch of the knob to be engaged with and anchored to the panel when the catch of the knob is rotated relative to the panel.

The bar includes a number of socket recesses formed in either of the end portions thereof, and defined between swellings, to receive the weights, and to anchor and position the weights to the bar. The bar includes a number of socket recesses formed in either of the end portions thereof, and defined between swellings, to receive the weights, and to anchor and position the weights to the bar.

The bar includes at least one flat surface formed in either of the end portions thereof, to engage with the weights, and to prevent the bar from being rotated relative to the weights. The end portions of the bar each includes a non-circular cross section for engage with the weights, and for preventing the bar from being rotated relative to the weights.

A base member may further be provided and may include two end portions each having a number of depressions formed therein to receive and to seat the weights respectively. The base member includes a protrusion extended into each of the depressions thereof, and the weights each includes a cavity formed therein, to receive the protrusion of the base member respectively, and to anchor and position the weights to the base member. The base member includes at least one partition extended upwardly therefrom, for seating and supporting the bar.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
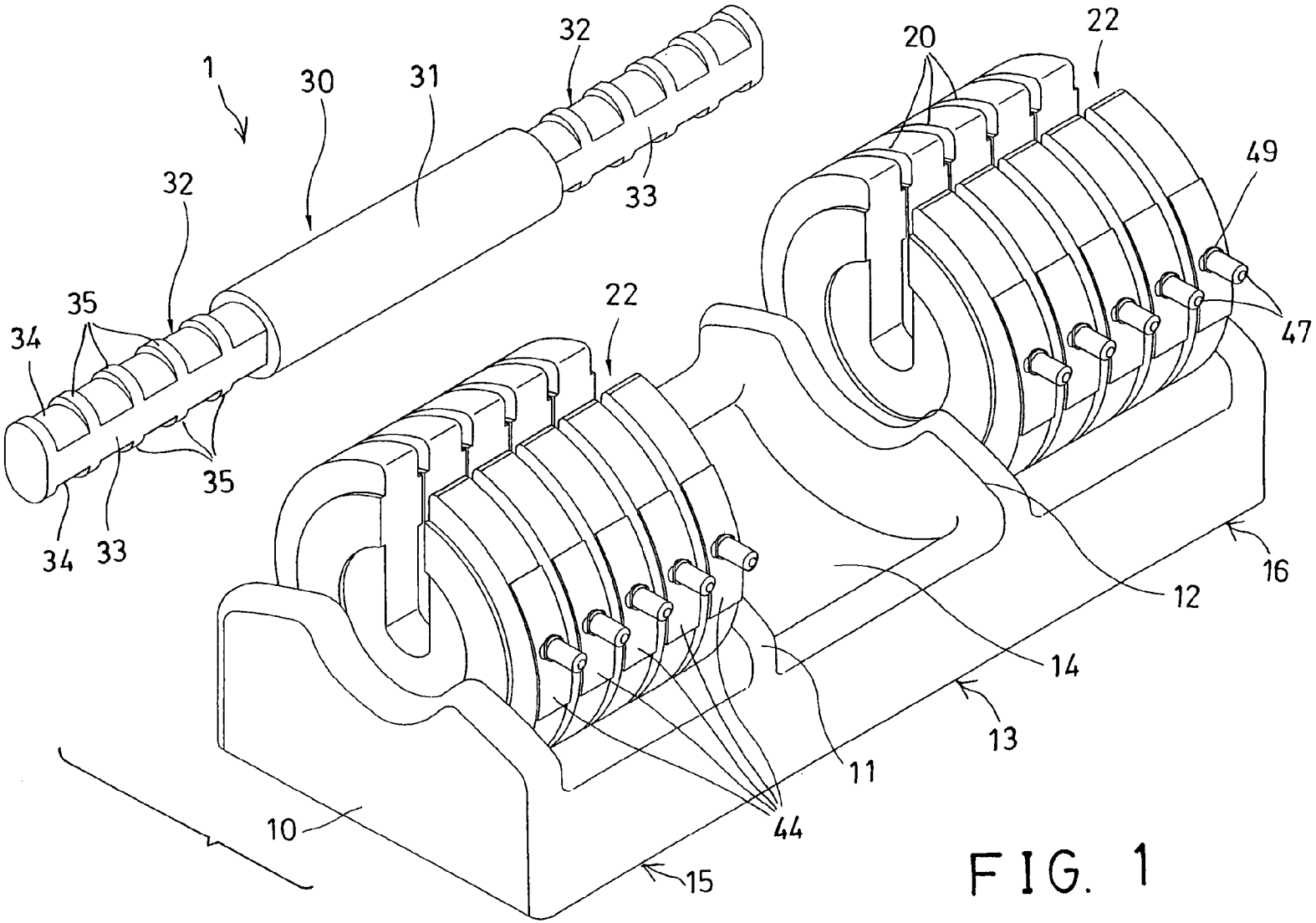
FIG. 1 is a partial exploded view of an adjustable dumbbell in accordance with the present invention.

Referring to the drawings, and initially to FIGS. 1–6, an adjustable dumbbell 1 in accordance with the present invention comprises a base supporting member or a base member 10 including one or more, such as two partitions 11, 12 extended upwardly from an intermediate portion 13 thereof, to form or define a recess 14 between the partitions 11, 12, and including two end portions 14, 15 each having a number of depressions 17 formed therein (FIG. 6), and a protrusion 18 extended into each of the depressions 17 thereof.

A number of dumbbell members or weights 20 are provided and engaged or received within the depressions 17 of the base member 10 respectively, and each includes a cavity 21 formed in bottom thereof, to receive the protrusion 18 of the base member 10 respectively, and thus to anchor or position the weights 20 to the base member 10, and to prevent the weights 20 from being tilting or rotating or moving relative to the base member 10. The weights 20 each includes a slot 22 formed in top or in the upper portion thereof, and preferably opened upwardly.

The weights 20 each includes a passage 23 laterally formed in one side portion thereof, and intersecting or communicating with the slot 22 thereof. It is preferable that the weights 20 each includes a peripheral rib 24 extended into an inner end of the passage 23 thereof, to form an aperture 25 having a reduced diameter, and arranged to have the reduced aperture 25 formed and located between the slot 22 and the passage 23 thereof.

A handle or bar 30 includes a handgrip 31 formed or provided on a middle or intermediate portion thereof, and arranged to be supported or seated on the partitions 11, 12 of the base member 10, and includes two end portions 32 to be received and engaged within the slots 22 of the weights 20, and preferably includes one or more, such as two cut off portions or flat surfaces 33 formed in side portions of the end portions 32 thereof, or may include a non-circular cross section for the end portions 32 thereof, to engage with the weights 20, and to prevent the bar 30 from being rotated relative to the weights 20.

The bar 30 may further include a number of socket recesses 34 formed in either or both the lower and the upper portions thereof, and defined between swellings 35, to receive the weights 20, and to further anchor or position the weights 20 to the bar 30, and to prevent the weights 20 from moving laterally along of the end portions 32 of the bar 30.

Figure 7:
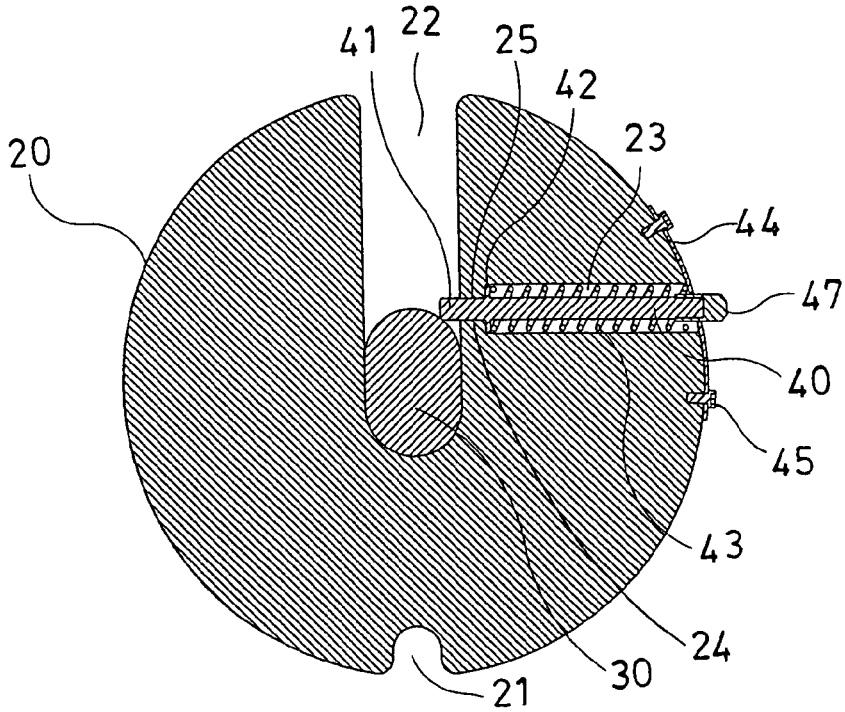
FIG. 7 is a cross sectional view of the adjustable dumbbell, taken along lines 7—7 of FIG. 3.

A number of latch rods 40 are slidably received and engaged within the passage 23 of the weights 20 respectively, and each includes one end or inner end 41 engageable into the slots 22 of the weights 20 respectively, and engageable with the bar 30 (FIGS. 6, 7), to anchor or latch or secure the weights 20 to the bar 30, and thus to allow the weights 20 to be moved in concert with the bar 30, and to allow the weights 20 to be moved away or disengaged from the base member 10 by the bar 30.

It is preferable that the latch rods 40 each includes a peripheral flange or a stop 42 extended from the inner end 41 thereof, for engaging with the peripheral ribs 24 of the weights 20 respectively, to anchor and to limit the latch rods 40 to move relative to the weights 20, and prevent the latch rods 40 from being deeply engaged into the slots 22 of the weights 20 respectively. A spring member 43 may further be provided and engaged onto each of the latch rods 40, such as engaged onto the stops 42 of the latch rods 40 respectively, to bias and to force the inner ends 41 of the latch rods 40 to engage with and thus to latch or secure the weights 20 to the bar 30.

A number of panels 44 may further be provided and secured onto the weights 20 respectively with such as fasteners 45, and each includes an orifice 46 formed therein and aligned with the passages 23 of the weights 20 respectively. It is preferable that the orifices 46 of the panels 44 each preferably includes a non-circular cross section. A button or knob 47 may further be provided and secured onto the outer ends 48 of the latch rods 40 respectively with such as fasteners (not shown) or threading engagements or the like, for allowing the knobs 47 to be moved in concert with the latch rods 40, and thus for allowing the latch rods 40 to be moved relative to the weights 20 and the panels 44 respectively. The outer ends 48 of the latch rods 40 may be moved in and out relative to the orifices 46 of the panels 44.

Figure 2:
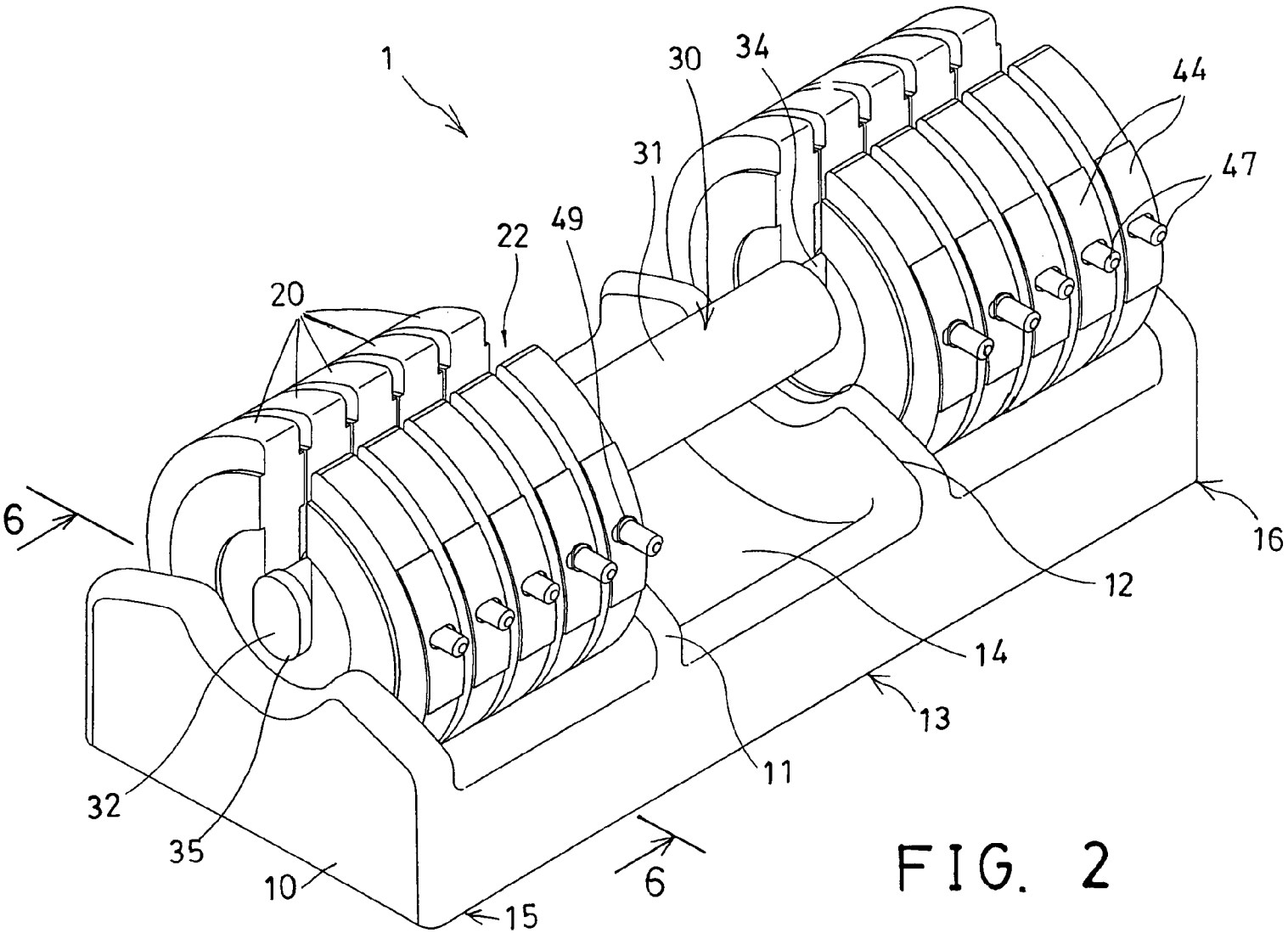
FIG. 2 is a perspective view of the adjustable dumbbell.
Figure 3:
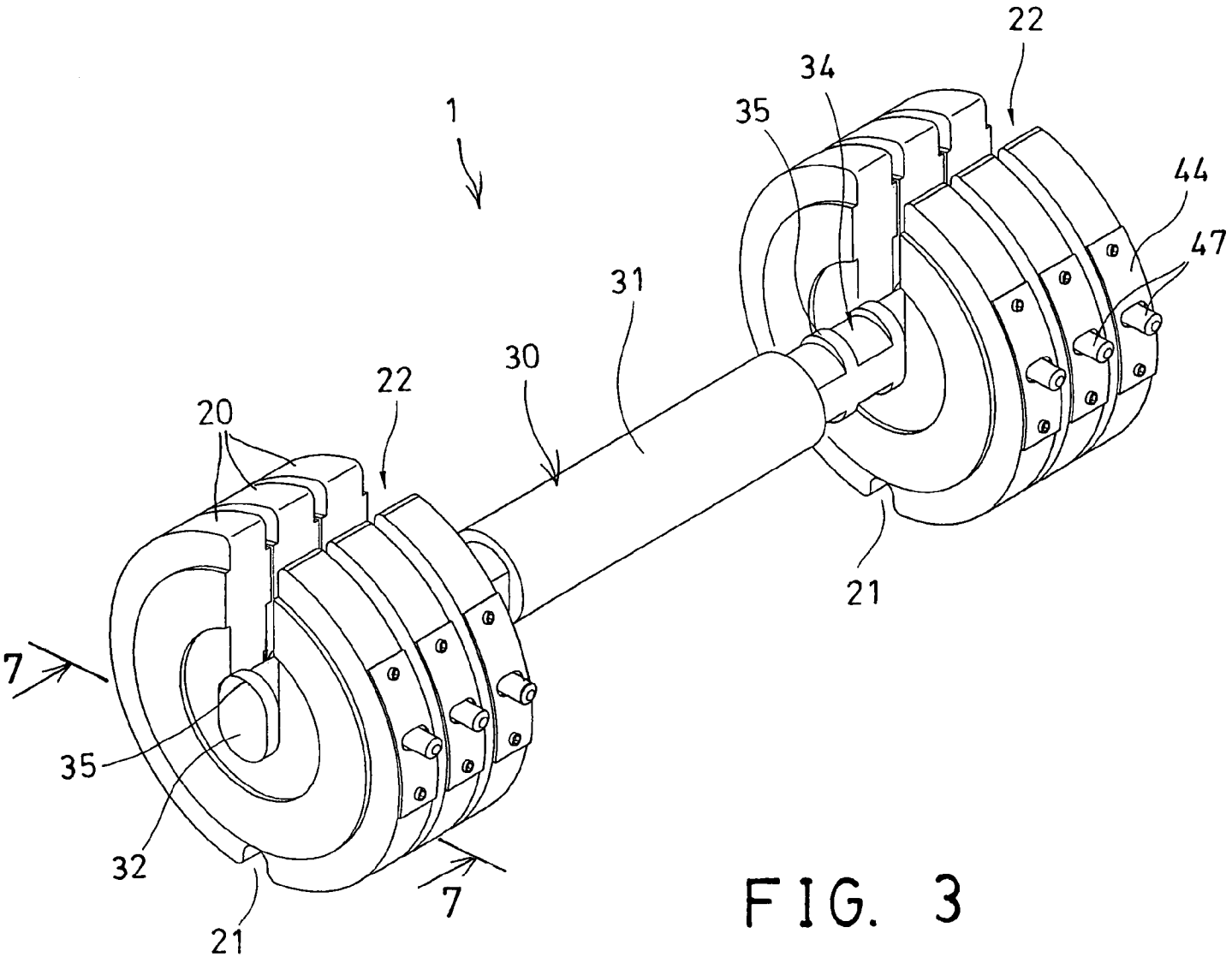
FIG. 3 is a perspective view of the adjustable dumbbell, in which a supporting base member has been removed.
Figure 4:
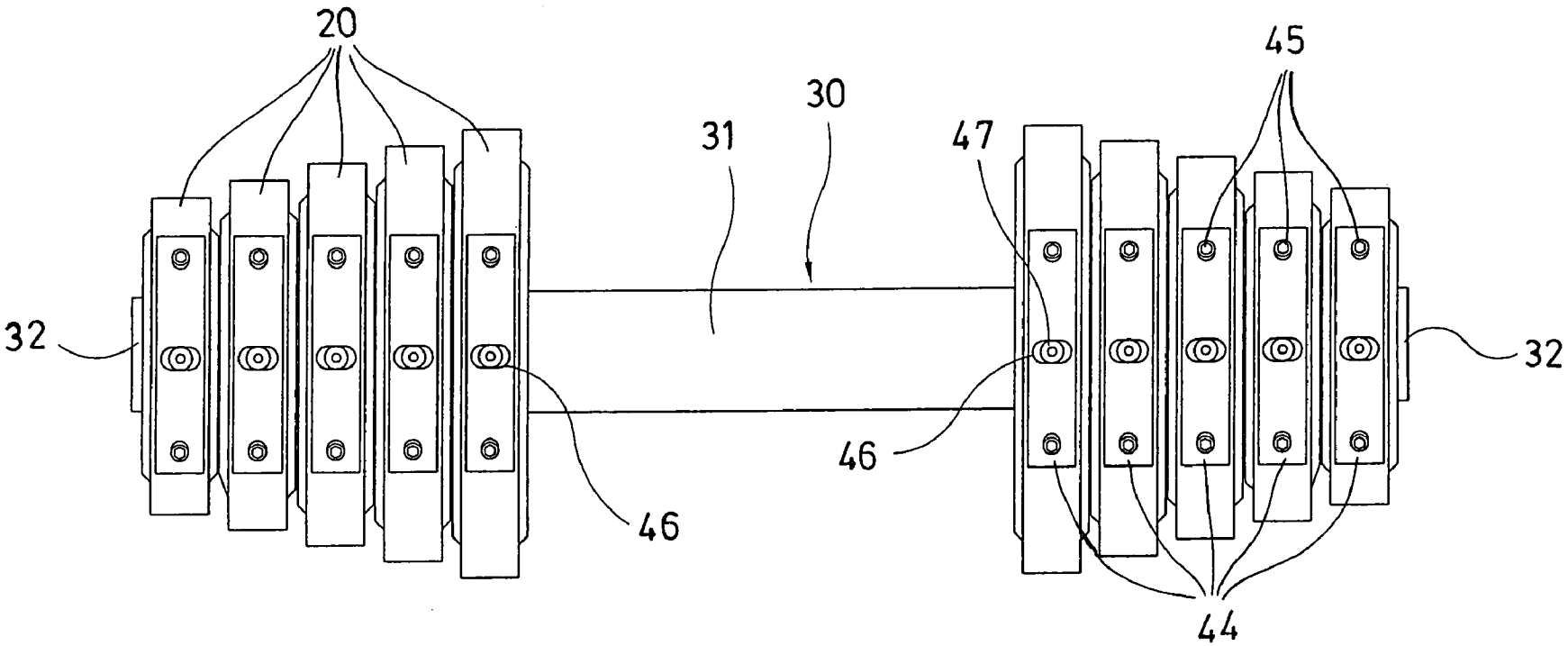
FIG. 4 is a side view of the adjustable dumbbell as shown in FIG. 3.
Figure 5:
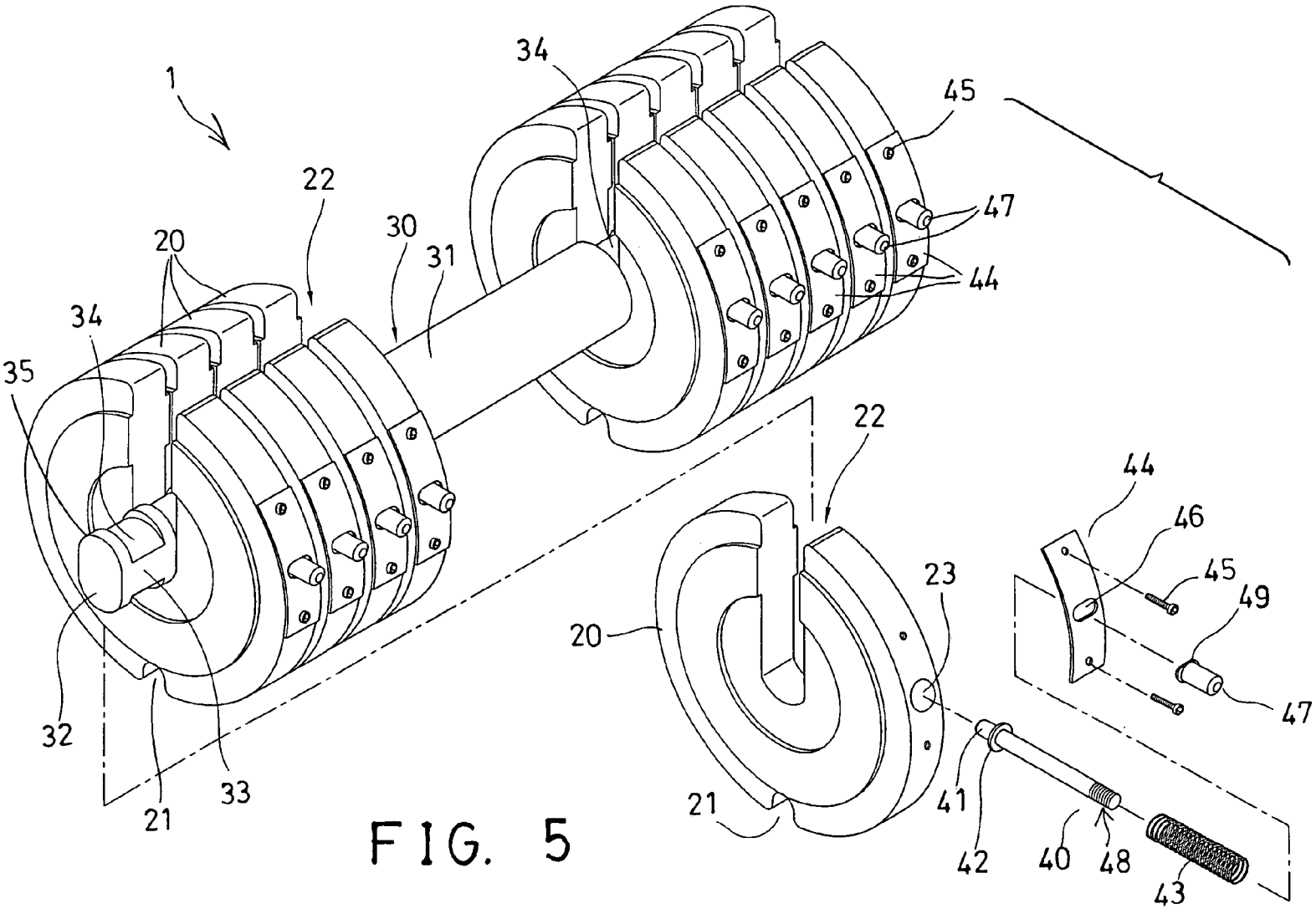
FIG. 5 is a partial exploded view of the adjustable dumbbell as shown in FIGS. 3 and 4.
Figure 6:
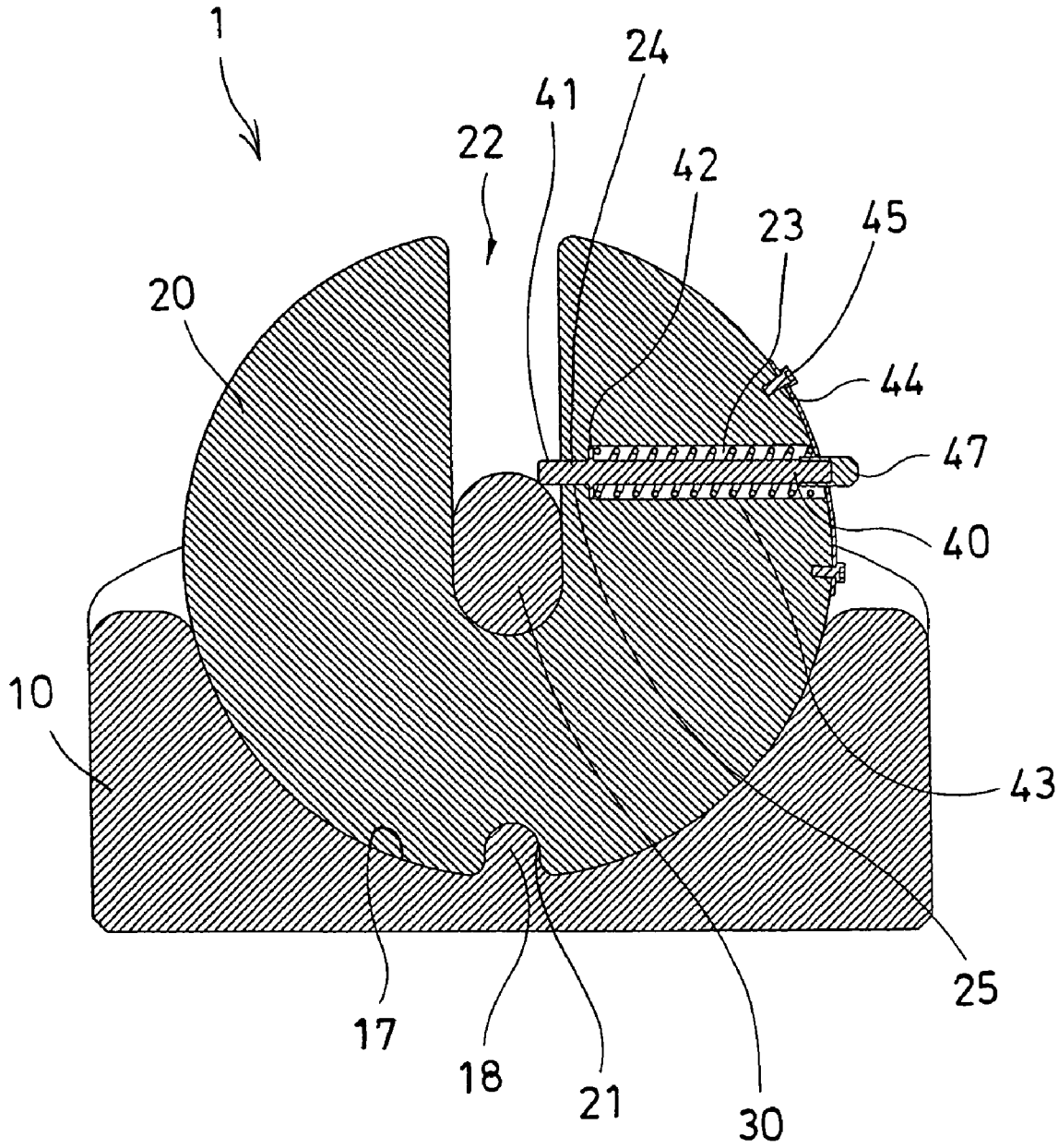
FIG. 6 is a cross sectional view of the adjustable dumbbell, taken along lines 6—6 of FIG. 2.

The knobs 47 may each include a catch 49 formed or provided thereon, and preferably having a non-circular cross section similar to or corresponding to that of the orifices 46 of the panels 44, to allow the catches 49 of the knobs 47 to be moved into and out through the orifices 46 of the panels 44. However, due to the non-circular cross sections of the orifices 46 of the panels 44 and the catches 49 of the knobs 47, the catches 49 of the knobs 47 may be engaged with or anchored to the panels 44 when the catches 49 of the knobs 47 are rotated relative to and engaged with the panels 44 (FIGS. 1, 2 and 8).

In operation, as shown in FIGS. 1–7, when the catches 49 of the knobs 47 of the selected latch rods 40 and/or of the selected weights 20 are disengaged from the panels 44 and engaged into the orifices 46 of the panels 44 respectively, the spring members 43 may bias and force the inner ends 41 of the latch rods 40 to engage with the weights 20 and thus to latch or secure the weights 20 to the bar 30, to allow the selected weights 20 to be moved away or disengaged from the base member 10 by the bar 30 and to be operated by the users.

Figure 9:
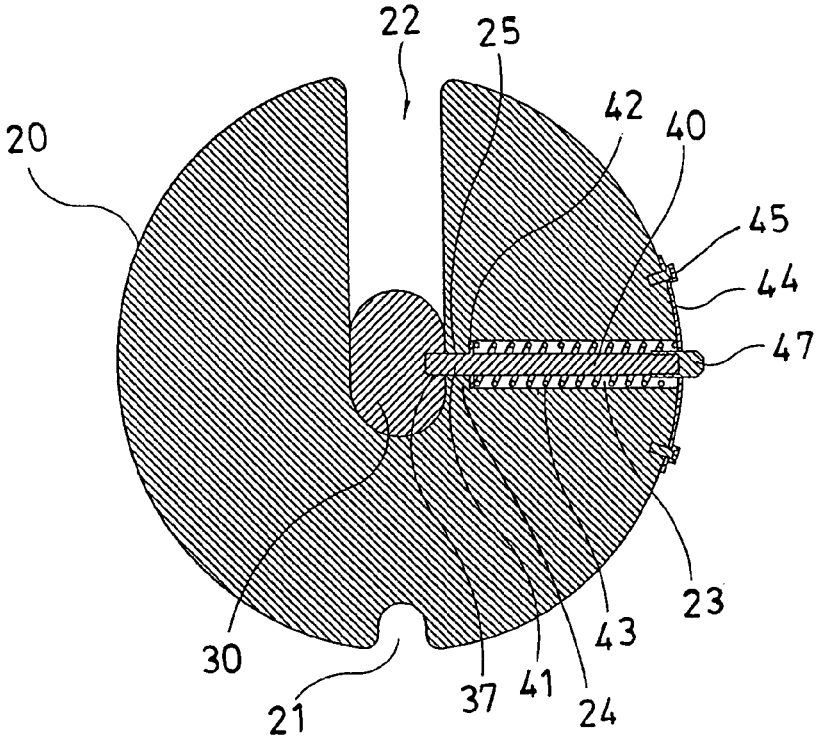
FIGS. 9, 10 are cross sectional views similar to FIGS. 7 and 8 respectively, illustrating the other arrangement of the adjustable dumbbell.
Figure 10:
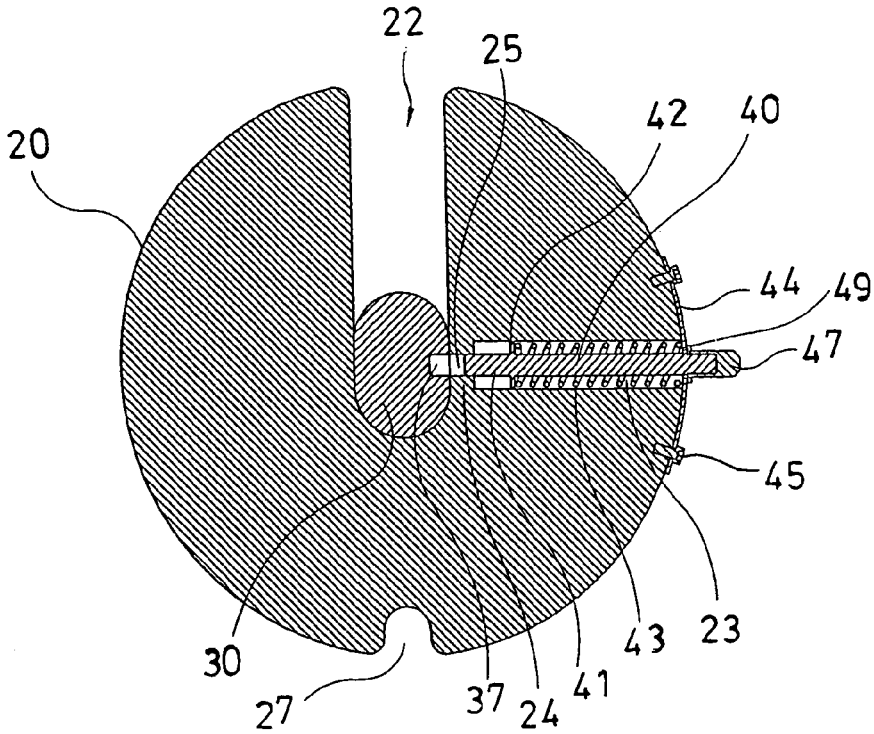

It is to be noted that the weights 20 each includes a latch rod 40 slidably received and engaged therein, and each includes an inner end 41 engageable into the slots 22 of the weights 20 and contactable or engageable with the bar 30, to allow the selected number of the weights 20 to be randomly secured or anchored to the bar 30, and to be suitably operated by the users. The weights 20 are not required to be secured or anchored to the bar 30 in series. Alternatively, as shown in FIGS. 9 and 10, the bar 30 may include a number of holes 37 formed therein, to receive the inner ends 41 of the latch rods 40, and thus to solidly secure the weights 20 to the bar 30.

Figure 8:
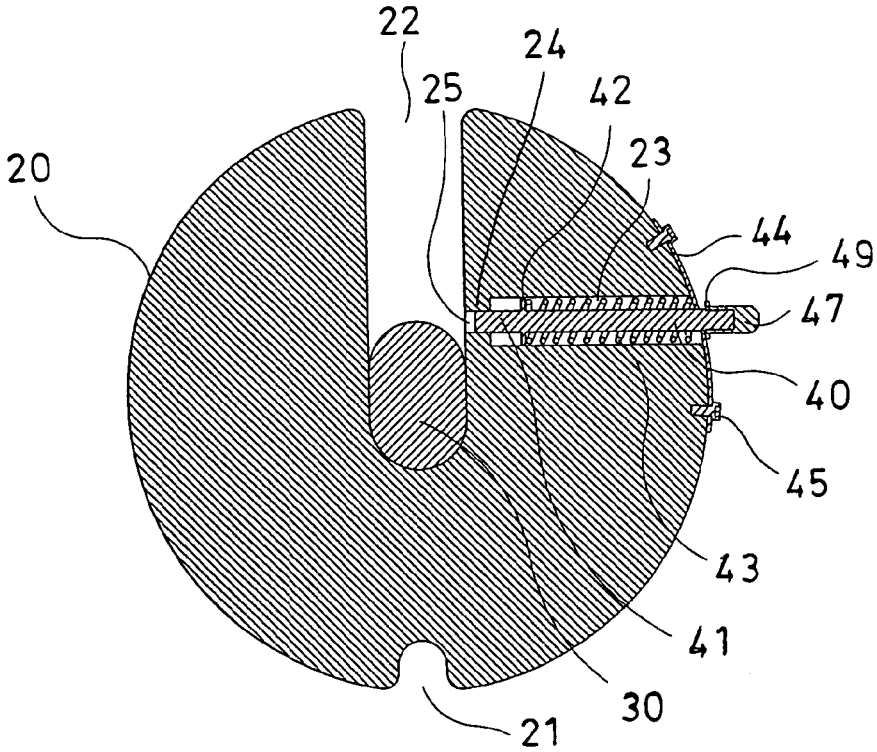
FIG. 8 is a cross sectional view similar to FIG. 7, illustrating the operation of the adjustable dumbbell.

When some or the other non-selected number of the weights 20 are not going to be secured to the bar 30, or are to be disengaged or unlocked from the bar 30, as shown in FIG. 8, the latch rods 40 may be pulled outwardly relative to the weights 20 with the knobs 47, against the spring members 43 respectively, to disengage the inner ends 41 of the latch rods 40 from the bar 30, and to unlock the non-selected weights 20 from the bar 30, and thus to prevent the non-selected weights 20 from being moved away or disengaged from the base member 10 by the bar 30.

The catches 49 of the knobs 47 may be moved out through the orifices 46 of the panels 44, and may be rotated relative to the weights 20 and the panels 44, and may thus be biased to engage with the panels 44 by the spring members 43, in order to maintain the disengagement of the inner ends 41 of the latch rods 40 from the bar 30, and thus to maintain the disengagement or the unlocking of the weights 20 from the bar 30.

Figure 11:
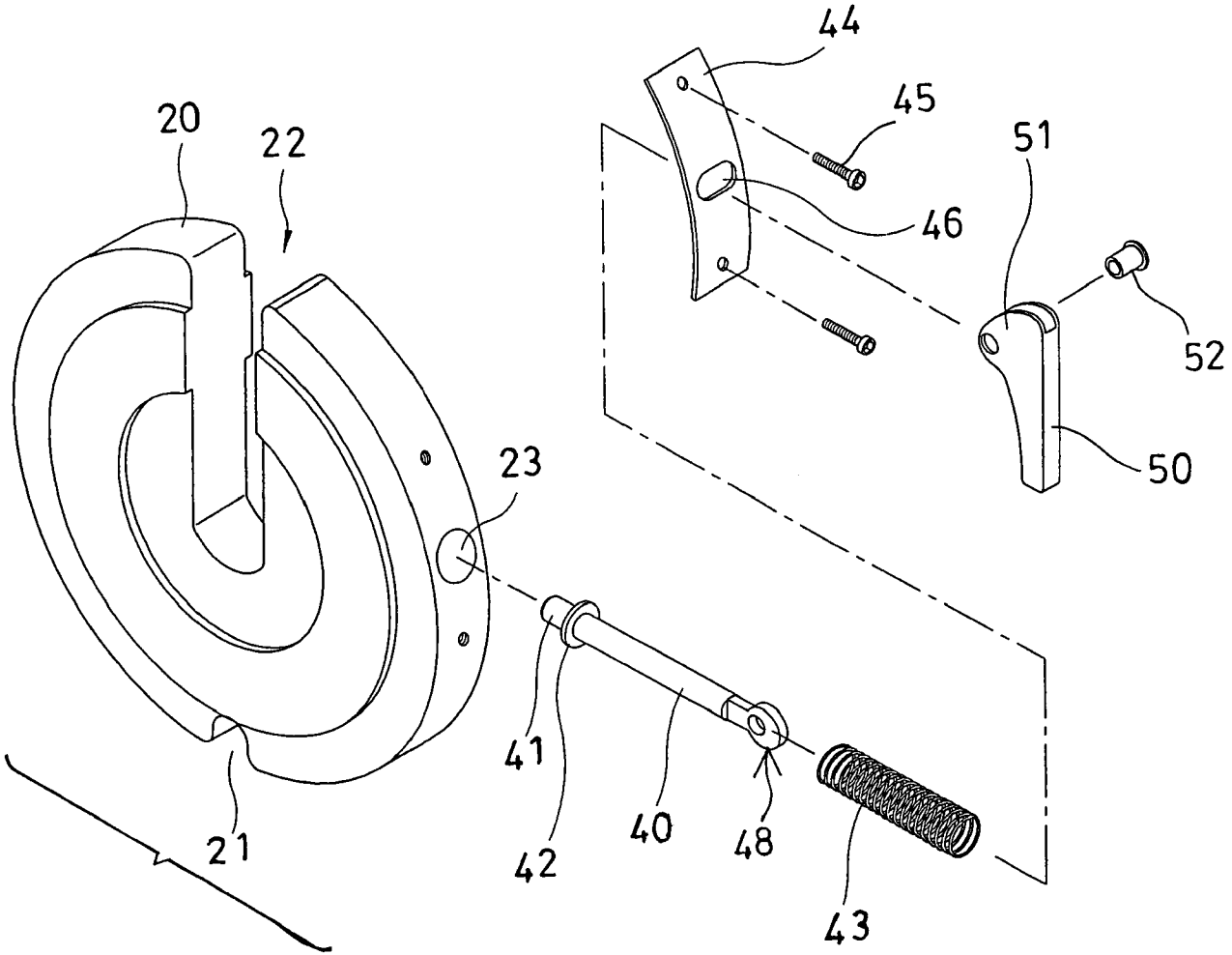
FIG. 11 is a further partial exploded view illustrating the other arrangement of the adjustable dumbbell.

Alternatively, as shown in FIG. 11, an actuating lever 50 may further be provided and may include a cam member 51 pivotally secured to the outer end 48 of each of the latch rods 40 with such as a pivot pin 52, to allow the latch rod 40 to be moved or operated relative to the weights 20 and the panels 44 and the bar 30 with the actuating lever 50.

Again, it is to be noted that the weights 20 each includes a latch rod 40 having an inner end 41 selectively engageable into the slots 22 of the weights 20 and contactable or engageable with the bar 30, to allow the randomly selected weights 20 to be individually or separately secured or anchored to the bar 30. For example, the first and the third and the fifth weights 20 may be selectively engaged or attached or secured to the bar 30, and the second and the fourth weights 20 are not required to be engaged or attached or secured to the bar 30.

Accordingly, the adjustable dumbbell in accordance with the present invention includes a number of weights to be randomly selected to a handle or bar, and to allow the desired number of the randomly selected weights to be randomly suitably operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a plurality of weights each including a slot formed therein, a bar including two end portions engageable into said slots of said weights, a plurality of latch rods slidably received and engaged within said weights respectively, and each including an inner end engageable into said slots of said weights respectively, and engageable with said bar, to anchor and latch a selected number of said weights to said bar, and to allow said selected weights to be moved in concert with said bar, said weights each including a spring member engaged onto said latch rod to bias and to force said inner ends of said latch rod to engage with and to latch said weights to said bar, said latch rods each including a stop extended therefrom for engaging with said spring member, and said weights each including a passage formed therein and communicating with said slot thereof, and a peripheral rib extended into said passage thereof to form an aperture having a reduced diameter, and to engage with said stop of said latch rod, and to limit said latch rod to move relative to said weight.

2. The adjustable dumbbell as claimed in claim 1, wherein said weights each includes a panel secured thereto and having an orifice formed therein and aligned with said passage of said weight, to slidably receive an outer end of said latch rod.

3. The adjustable dumbbell as claimed in claim 2, wherein said latch rods each includes a knob secured to said outer end thereof, said orifice of said panel includes a non-circular cross section, and said knob includes a catch provided thereon and having a non-circular cross section corresponding to that of said orifice of said panel, to allow said catch of said knob to be moved into and out through said orifice of said panel, and to allow said catch of said knob to be engaged with said panel when said catch of said knob is rotated relative to said panel.

4. The adjustable dumbbell as claimed in claim 1, wherein said bar includes a plurality of socket recesses formed in either of said end portions thereof, and defined between swellings, to receive said weights, and to anchor and position said weights to said bar.

5. The adjustable dumbbell as claimed in claim 1, wherein said bar includes at least one flat surface formed in either of said end portions thereof, to engage with said weights, and to prevent said bar from being rotated relative to said weights.

6. The adjustable dumbbell as claimed in claim 1, wherein said end portions of said bar each includes a non-circular cross section for engage with said weights, and for preventing said bar from being rotated relative to said weights.

7. The adjustable dumbbell as claimed in claim 1 further comprising a base member including two end portions each having a plurality of depressions formed therein to receive and to seat said weights respectively.

8. The adjustable dumbbell as claimed in claim 7, wherein said base member includes a protrusion extended into each of said depressions thereof, and said weights each includes a cavity formed therein, to receive said protrusion of said base member respectively, and to anchor and position said weights to said base member.

9. The adjustable dumbbell as claimed in claim 7, wherein said base member includes at least one partition extended upwardly therefrom, for seating and supporting said bar.

* * * * *